US008588433B2

(12) United States Patent
Saulespurens et al.

(10) Patent No.: US 8,588,433 B2
(45) Date of Patent: Nov. 19, 2013

(54) ELECTRET MICROPHONE CIRCUIT

(75) Inventors: Martins Saulespurens, Westlake Village, CA (US); Felikss Stanevics, Riga (LV)

(73) Assignee: Baltic Latvian Universal Electronics, LLC, Westlake Village, CA (US)

( * ) Notice: Subject to any disclaimer, the term of this patent is extended or adjusted under 35 U.S.C. 154(b) by 917 days.

(21) Appl. No.: 12/726,237

(22) Filed: Mar. 17, 2010

(65) Prior Publication Data

US 2011/0228954 A1 Sep. 22, 2011

(51) Int. Cl.
*H04R 3/00* (2006.01)

(52) U.S. Cl.
USPC ..... 381/113; 381/111; 381/112; 381/114; 381/115; 381/120; 381/122; 381/26; 381/355; 381/56; 381/311; 381/102; 381/92; 381/104; 381/95; 330/311; 330/258; 330/126; 330/300; 330/255; 330/277

(58) Field of Classification Search
USPC ..... 381/111–115, 120, 122, 26, 355, 156, 381/311, 255, 92; 330/311, 258, 126, 300, 330/255, 277
See application file for complete search history.

(56) References Cited

U.S. PATENT DOCUMENTS

| | | | | |
|---|---|---|---|---|
| 5,097,224 | A | 3/1992 | Madaffari et al. | |
| 5,978,491 | A | 11/1999 | Papadopoulos | |
| 6,084,972 | A | 7/2000 | van Halteren et al. | |
| 6,160,450 | A | 12/2000 | Eschauzzier et al. | |
| 6,218,883 | B1 | 4/2001 | Takeuchi | |
| 6,577,187 | B1 * | 6/2003 | Lesko | 330/11 |
| 6,580,797 | B1 | 6/2003 | Papadopoulos et al. | |
| 6,784,748 | B1 * | 8/2004 | Canyon et al. | 330/296 |
| 7,046,815 | B2 * | 5/2006 | Akino et al. | 381/122 |
| 7,372,967 | B2 * | 5/2008 | Henson et al. | 381/111 |
| 7,970,154 | B2 * | 6/2011 | Akino | 381/113 |
| 2006/0220684 | A1 * | 10/2006 | Khoo et al. | 326/83 |
| 2008/0019540 | A1 * | 1/2008 | van Kats et al. | 381/113 |
| 2009/0285415 | A1 * | 11/2009 | Wu | 381/113 |
| 2010/0310096 | A1 * | 12/2010 | Josefsson et al. | 381/113 |

OTHER PUBLICATIONS

Arie Van Rhijn, "Integrated Circuits for High Performance Electret Microphones", Audio Engineering Society Convention Paper, Presented at the 114th Convention, Mar. 22-25, 2003 Amsterdam, The Netherlands, 7 Pages.

* cited by examiner

*Primary Examiner* — Davetta W Goins
*Assistant Examiner* — Kuassi Ganmavo
(74) *Attorney, Agent, or Firm* — SoCal IP Law Group LLP; John E. Gunther; Steven C. Sereboff

(57) ABSTRACT

There is disclosed a microphone, a circuit, and a method. A microphone capsule may include an electret microphone and a field effect transistor (FET). A floating DC voltage source may have a first end connected to a drain terminal of the electret microphone capsule and a second end. A load resistor may be connected between the second end of the floating DC voltage source and a source terminal of the electret microphone capsule. A voltage follower may have an output connected to the source terminal of the electret microphone capsule and the first end of the floating DC voltage source. A coupling capacitor may couple an audio signal from the source terminal of the electret microphone capsule to an input of the voltage follower.

22 Claims, 4 Drawing Sheets

ELECTRET MICROPHONE CIRCUIT

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to microphones for converting acoustic waves to electrical signals, and specifically to high performance microphone systems using electret microphones.

2. Description of the Related Art

An electrostatic microphone, also commonly called a condenser microphone, contains a fixed plate and a flexible diaphragm that collectively form a parallel plate capacitor. The diaphragm moves in response to incident acoustic waves, thus modulating the capacitance of the parallel plate capacitor. A polarizing voltage must be applied via a high value load resistor to charge or polarize the parallel plate capacitor. Variations in the capacitance in response to incident acoustic waves may then be sensed as modulation of the voltage across the capacitor.

An electret microphone is a variation of an electrostatic microphone in which at least one of the fixed plate and the diaphragm include a permanently charged dielectric layer. The presence of the permanent charge obviates the need for a polarizing voltage source to charge the parallel plate capacitor. Electret microphones are used in many applications, from high-quality sound recording to built-in microphones in consumer electronic devices. Nearly all cell-phones, computers, and headsets incorporate electret microphones.

Electret microphones are commonly produced in the form of a "capsule" containing the parallel-plate capacitor microphone and a circuit or preamplifier to transform the high impedance of the parallel-plate capacitor microphone to a lower impedance value. As shown in FIG. 1A, an electret microphone capsule 105 may include an electret microphone EM and a field-effect transistor (FET) Q1 having gate (G), source (S), and drain (D) contacts. A high value (for example, greater than 1 Gigohm) resistor R1 between the gate and drain contacts may be provided or intrinsic to the FET Q1. Although not shown in FIG. 1A, the FET Q1 will have intrinsic parasitic capacitances between the gate, drain, and source contacts and intrinsic parasitic resistances at each of the gate, drain, and source contacts. The values of the parasitic capacitances and resistances may depend, to some extent, on the voltages imposed between the contacts of the FET Q1.

The drain of the FET Q1 may be electrically connected to a first terminal T1 of the electret microphone capsule 105. The source of the FET Q1 may be electrically connected to a second terminal T2 of the electret microphone capsule 105.

The electret microphone EM may include a diaphragm 101 and a fixed plate 102. One side of the electret microphone EM (either the diaphragm 101 or the fixed plate 102) may be electrically connected to the gate of the FET Q1. In the exemplary electret microphone capsule 105 shown in FIG. 1A, the fixed plate 102 of the electret microphone EM is connected to the gate of the FET Q1. In "two-terminal" electret capsules, the second side of the electret microphone EM may be electrically connected to the source of the FET Q1 and thus the second terminal T2. In "three-terminal" electret capsules, as shown in FIG. 1A, the second side of the electret microphone EM may be electrically connected to a third terminal T3 of the electret microphone capsule 105. The third terminal T3 may be connected to a bias voltage $V_{bias}$ external to the electret microphone capsule 105. The value of the bias voltage $V_{bias}$ may determine, at least in part, the performance of the electret microphone EM.

Terminals T1, T2, and T3 (if present) may also be referred to as the source terminal, the drain terminal, and the bias terminal, respectively of the electret microphone capsule 105. Terminals T1, T2, and T3 may be configured to make electrical contact with corresponding terminals external to the electret microphone capsule 105. For example, terminals T1, T2, and T3 may be pins for insertion into a connector or solder pads to be reflow soldered to a circuit board external to the electret microphone capsule 105. Terminals T1, T2, and T3 may be solderless pads to electrically contact spring wipers or other structures external to the electret microphone capsule 105. Terminals T1, T2, and T3 may be some other structures or devices for making electrical contact to corresponding terminals external to the electret microphone capsule 105.

The drain and source of the FET Q1 may be separately connected via terminals T1 and T2, respectively, to components external to the electret microphone capsule 105. In the example of FIG. 1A, the FET Q1 is used as an inverting preamplifier. The source of FET Q1 is electrically connected to ground via terminal T2, and a voltage $V_{DS}$ is applied to the drain of FET Q1 through a load resistor $R_L$, and terminal T1. A signal voltage applied to the gate of the FET Q1 by the electret microphone EM will be amplified by the FET Q1. The amplified signal may be output from the electret microphone capsule 105 at terminal T1. In this configuration, the voltage between the source and gate of FET Q1 will vary in accordance with the amplified output signal. Variations of the voltage between the source and drain of FET Q1 will cause corresponding changes in the parasitic capacitances within FET Q1, which may contribute to distortion of the amplified signal. Additionally, the apparent input capacitance of the FET Q1 will be increased due to Miller-effect multiplication of the parasitic gate-source capacitance of the FET Q1. The high apparent input capacitance is effectively in parallel with the capacitance of the electret microphone EM, and thus may reduce the audio signal level output from the electret microphone EM. Additionally, since parasitic gate-source capacitance of the FET Q1 may vary nonlinearly with voltage, the Miller-effect multiplication of this capacitance may cause distortion of the audio signal.

In the example of FIG. 1B, the FET Q1 is used as source follower. The source of FET Q1 is electrically connected to ground via terminal T2 and a load resistor $R_L$, and a voltage $V_{DS}$ is applied to the drain of FET Q1 via terminal T1. A signal voltage applied to the gate of the FET Q1 by the electret microphone EM will be output from terminal T2 without amplification. In this configuration, the voltage between the source and gate of FET Q1 will vary in accordance with the amplified output signal. Variations of the voltage between the source and drain of FET Q1 will cause corresponding changes in the parasitic capacitances within FET Q1, which may contribute to distortion of the amplified signal. However, the apparent input capacitance of the FET Q1 will be lower than that of the configuration of FIG. 1A.

Throughout this description, elements appearing in figures are assigned three-digit reference designators, where the most significant digit is the figure number where the element first appears, and the two least significant digits are specific to the element. In electrical schematic diagrams, circuit components may be assigned conventional labels. The same labels (for example "R1") may serve both to identify the component within a schematic diagram and to represent the value of the component in formulas. An element that is not described in conjunction with a figure may be presumed to have the same characteristics and function as a previously-described element having the same label or reference designator.

DETAILED DESCRIPTION

Figure 1B:
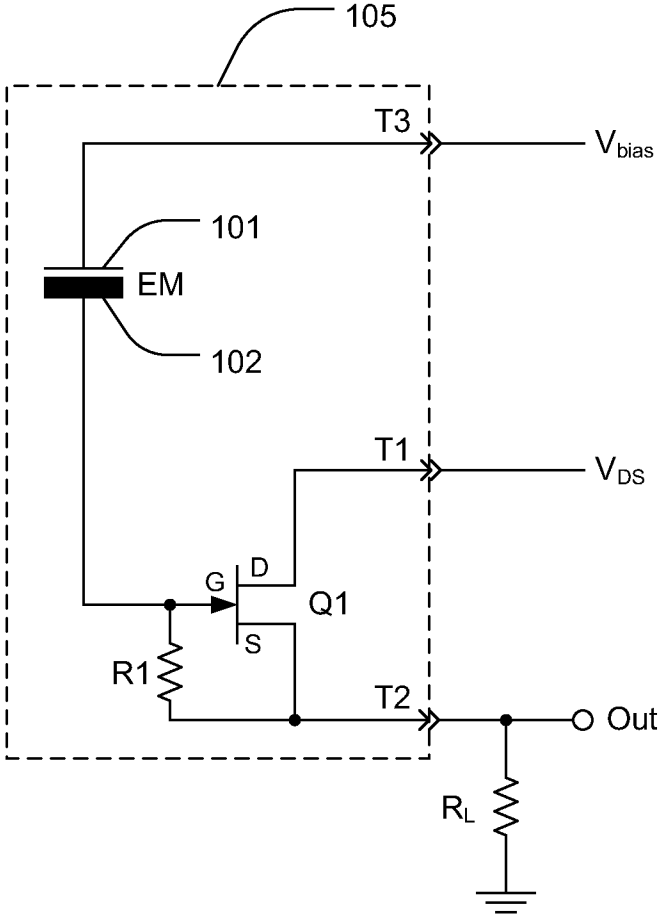
FIG. 1B Prior Art
FIG. 1B is a schematic diagram of another conventional electret microphone circuit.
Figure 2:
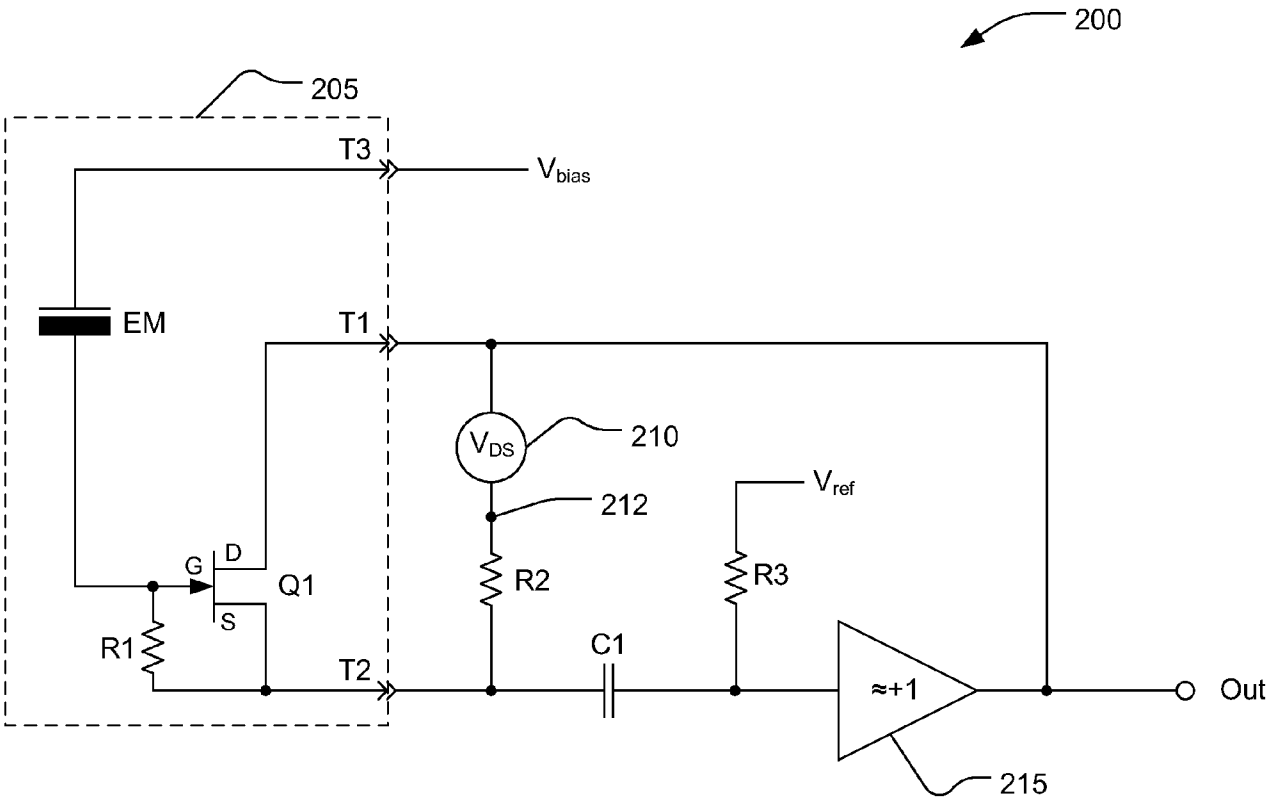
FIG. 2 is a schematic diagram of an electret microphone circuit.

Referring now to FIG. 2, an electret microphone circuit 200 may include a three-terminal electret microphone capsule 205, which may be the electret microphone capsule 105. A voltage source 210 in series with a resistor R2 may be connected from terminal T1 to terminal T2 of the electret microphone capsule 205. A first end of the voltage source 210 may be connected to terminal T1 of the electret microphone capsule 205. A second end of the voltage source 210 may be connected to a first end of the resistor R2 at a node 212. A second end of resistor R2 may be connected to terminal T2 of the electret microphone capsule 205. Note that, if the node 212 between the voltage source 210 and the resistor R2 was grounded, the FET Q1 within the electret microphone capsule would be operating as source follower as shown in FIG. 1B. In the circuit of FIG. 2, however, the voltage source is floating with respect to ground potential. In this context, the term "floating" means that the node 212 is free to change voltage with respect to ground.

An audio signal voltage applied to the gate of the FET Q1 by the electret microphone EM will be output from terminal T2 without amplification. The audio signal output at terminal T2 may be coupled to an input of a voltage follower 215 through a coupling capacitor C1. A voltage follower is a circuit that provides an output voltage that dynamically follows an input voltage, which is to say that a change in the input voltage results in a corresponding change in the output voltage. The gain of a voltage follower, defined as the ratio of the change in output voltage to the change in input voltage may be equal to or slightly less than one. There may or may not be a DC voltage offset between the output voltage and the input voltage of a voltage follower.

The input of the voltage follower 215 may be connected to a DC reference voltage $V_{ref}$ through a resistor R3. The capacitor C1 and the resistor R3 may function as a high-pass filter that couples the audio signal, but not a DC voltage level, from terminal T2 of the electret microphone capsule 205 to the input of the voltage follower 215. The values of the capacitor C1 and the resistor R3 may be selected such that the high pass filter couples the entire audio frequency spectrum from terminal T2 to the input of the voltage follower 215 without significant attenuation. Thus the audio signal output from the voltage follower 215 may be essentially equal to, except for DC level, the audio signal output from terminal T2 of the electret microphone capsule 205, which in turn may be nearly equal to the audio signal imposed on the gate of FET Q1 by the electret microphone EM.

The output of the voltage follower 215, which may serve as the output from the microphone circuit 200, may be connected to terminal T1 of the electret microphone capsule 205 and to the first end of the floating voltage source 210. In this manner, the drain of the FET Q1 receives an audio signal voltage essentially equal, except for DC level, to the audio signal output from the source of the FET Q1. Thus the following relationships may hold, independent of the audio signal level imposed on the gate of FET Q1 by the electret microphone EM:

$$V_G \approx V_S \approx V_D - V_{DS} + V_{R2} \quad (1)$$

wherein: $V_G$, $V_S$, $V_D$=voltage at the gate, source, and drain of FET Q1, respectively;

$V_{DS}$=voltage of the floating voltage source 210; and $V_{R2}$=DC voltage drop across resistor R2.

Since the relative voltage values on the gate, source, and drain of the FET Q1 are essentially constant, independent of the audio signal level, the values of the parasitic capacitances and resistances within the FET Q1 remain constant. Further, since the relative voltage values on the gate, source, and drain are essentially constant, little or no audio signal current may flow in the parasitic capacitances. The dynamic value, or the effective value for the audio signal, of the parasitic capacitances may be close to zero. Thus the parasitic components within the FET Q1 may not cause distortion of the audio signal. Similarly, since little or no audio signal current may flow through the load resistor R2 and the floating voltage source 210, the dynamic value of the load resistor may be very high. Specifically, if the gain of the voltage follower 215 is A, where A is less than but nearly equal to one, the dynamic load resistance at the source of FET Q1 may be given by:

$$R_{AC} \approx (R_{DC})/(1-A) \quad (2)$$

wherein: $R_{AC}$=the dynamic load resistance; and $R_{DC}$=DC resistance of resistor R2.

The high dynamic load resistance may result in an essentially constant current flow from the drain to the source of FET Q1, independent of the audio signal level. In the electret microphone circuit 200, the FET Q1 may function to transform the very high impedance of the electret microphone EM to a low impedance essentially without attenuation, distortion, or other degradation of the audio signal from the electret microphone.

Still referring to FIG. 2, a method of operating an electret microphone capsule, such as the electret microphone capsule 205, may include applying an essentially constant DC voltage between the drain terminal T2 and the source terminal T1 of the electret microphone capsule 205 through a load resistor R2 in series with the source terminal. The method may further include coupling an audio signal from the source terminal T2 of the electret microphone capsule 205 through a capacitor C1 to an input of a voltage follower 215, and applying the output voltage from the voltage follower 215 to the drain terminal T1 of the electret microphone capsule 205. The method of operating an electret microphone capsule may additionally include applying a bias voltage to a bias terminal T3 of the electret microphone capsule 205.

Figure 3:
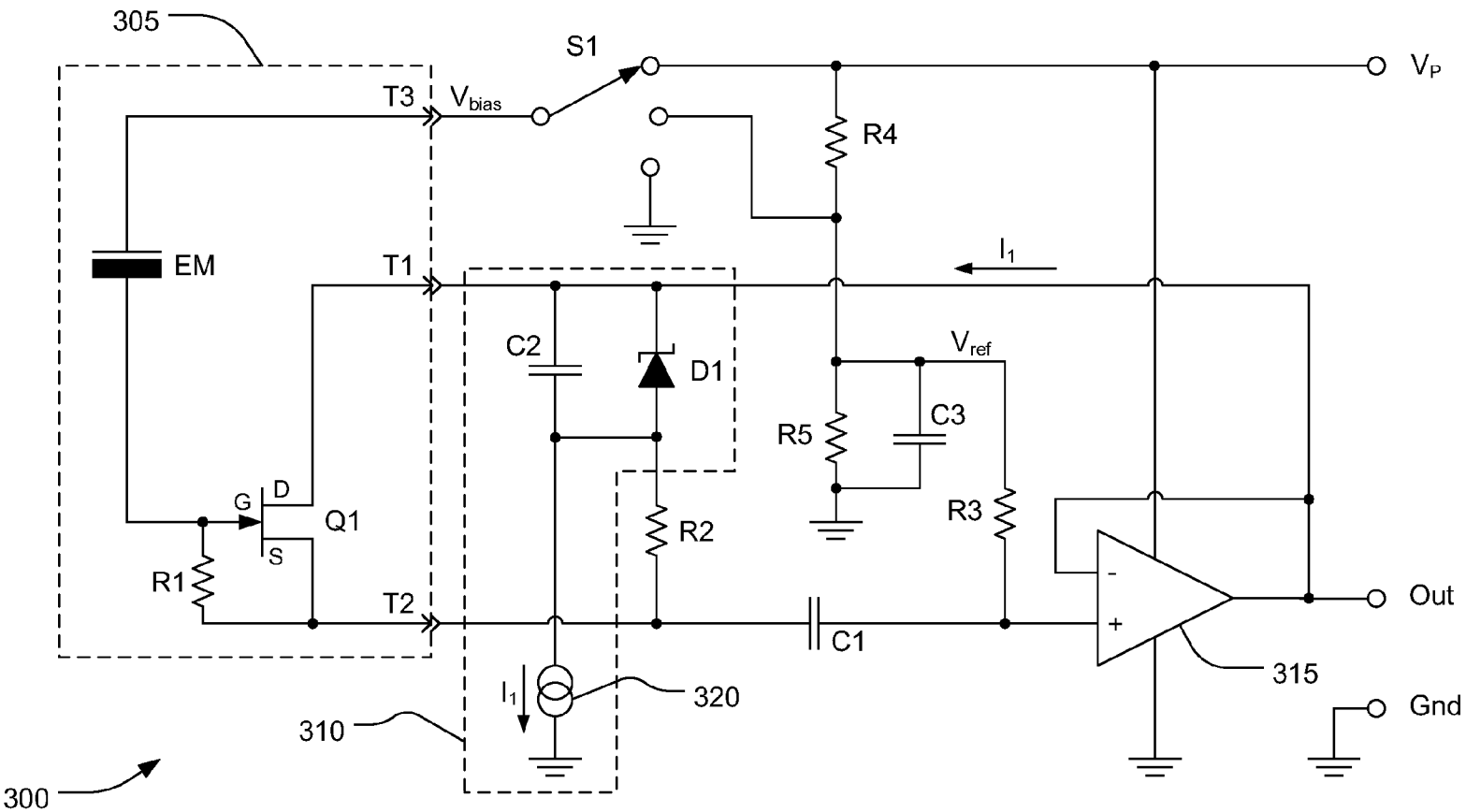
FIG. 3 is a schematic diagram of an electret microphone circuit.

Referring now to FIG. 3, another electret microphone circuit 300 may include a three-terminal electret microphone capsule 305, which may be the electret microphone capsule 105, a floating source 310, and a voltage follower 315. The improved electret microphone circuit 300 may operate from a DC power supply voltage $V_P$. The DC power supply voltage $V_P$ may be extracted from the "phantom power" commonly provided by an audio preamplifier (not shown in FIG. 3) via an audio cable (not shown) connecting a microphone circuit to the preamplifier. Known techniques and circuits (not shown) for extracting a DC supply voltage from the "phantom power" may be used in conjunction with the microphone circuit 300.

The voltage follower 315 may be, as shown in FIG. 3, an operational amplifier having inverting (−) and non-inverting (+) inputs. The operational amplifier may be operated with absolute negative feedback, which is to say the inverting input may be connected directly to the output of the operational amplifier. The operational amplifier may then provide a gain of essentially one from the non-inverting input to the output. For example, if the operation amplifier has an open-loop gain of 10,000, the gain of the amplifier with absolute negative feedback may be about 0.9999. The non-inverting input of the voltage follower 315 may be connected to a DC reference voltage $V_{ref}$ through a resistor R3. The DC reference voltage may be provided, for example, by resistors R4 and R5, which act to divide the DC power supply voltage $V_P$, and a bypass capacitor C3.

The non-inverting input of the voltage follower 315 may receive an audio signal from terminal T2 of the electret microphone capsule 305 through a coupling capacitor C1. The capacitor C1 and the resistor R3 may function as a high-pass filter that couples the audio signal, but not a DC voltage level, from terminal T2 of the electret microphone capsule 305 to the non-inverting input of the voltage follower 315. The values of the capacitor C1 and the resistor R3 may be selected such that the high pass filter couples the entire audio frequency spectrum from terminal T2 to the non-inverting input of the voltage follower 315 without significant attenuation. The output of the voltage follower 315, which may serve as the output from the microphone circuit 300, may be connected to terminal T1 of the electret microphone capsule 305 and to a first end of the floating voltage source 310.

The floating voltage source 310 may include a zener diode D1 and a constant current circuit 320 connected such that a constant current $I_1$ flows from the output of the voltage follower 315 to the constant current circuit 320 via the zener diode D1 and/or the FET Q1. A small portion of the constant current $I_1$ may flow though the drain of FET Q1 to the source of FET Q1. A majority of the constant current $I_1$ may flow through the zener diode D1 such that the voltage across the zener diode remains essentially constant independent of the audio signal level. A capacitor C2 may be provided to bypass any audio signal current around the zener diode D1.

In the example of FIG. 3, a third terminal T3 of the electret microphone capsule 305 may be connected to a bias voltage $V_{bias}$. The bias voltage may be selected, by switch S1, to be one of ground, the DC power supply voltage $V_P$, or the intermediate voltage $V_{ref}$. The selection of the bias voltage may affect the operation of the electret microphone EM. For example, the selection of the bias voltage may affect the sensitivity of the electret microphone EM. Additionally, a high bias voltage may increase the tension of the diaphragm within the electret microphone and thus alter, to at least some extent, the frequency response of the microphone.

Figure 4:
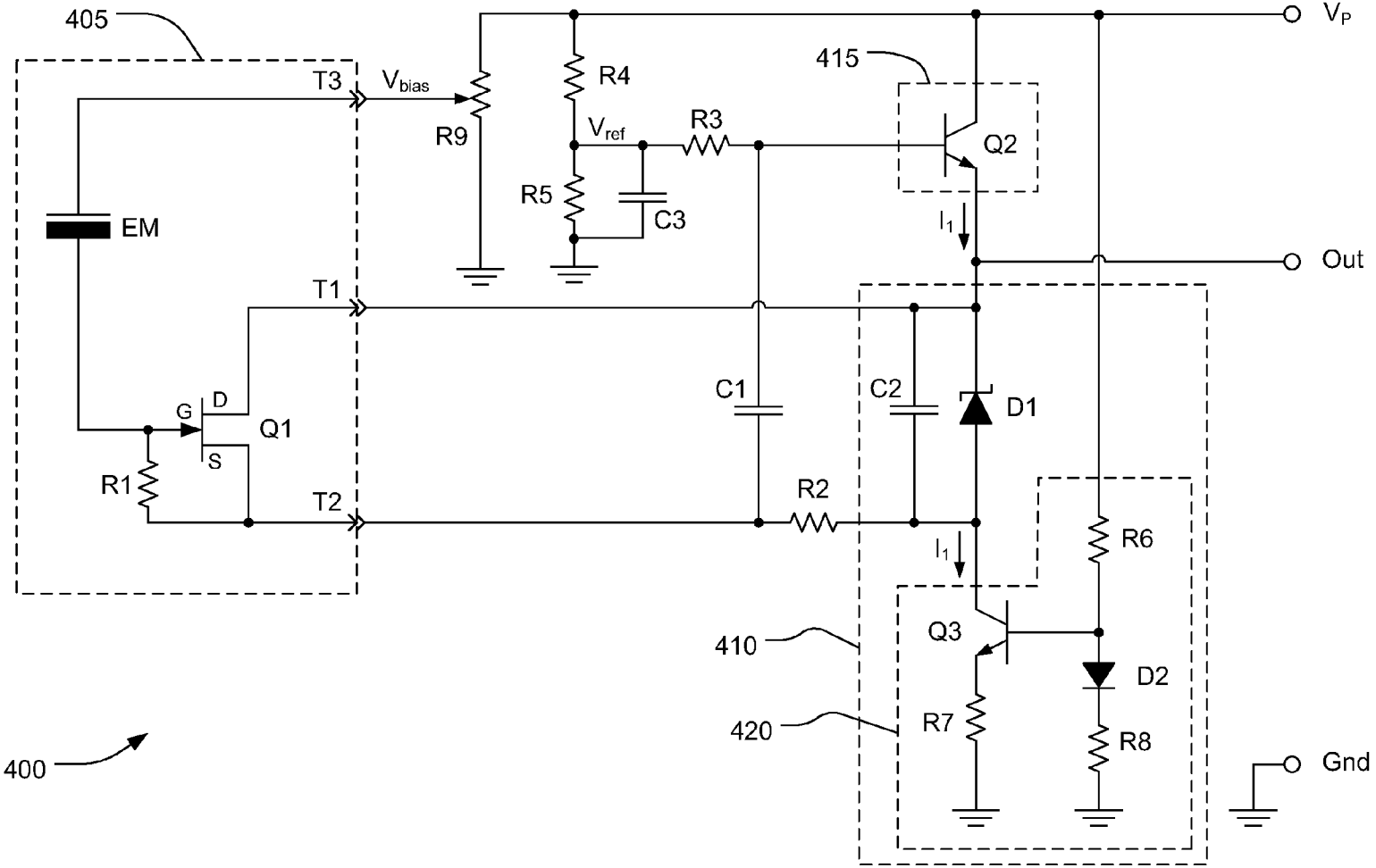
FIG. 4 is a schematic diagram of an electret microphone circuit.

Referring now to FIG. 4, another electret microphone circuit 400 may include a three-terminal electret microphone capsule 405, which may be the electret microphone capsule 105, a floating voltage source 410, and a voltage follower 415. The improved electret microphone circuit 400 may operate from a DC power supply voltage $V_P$. The DC power supply voltage $V_P$ may be extracted from the "phantom power" commonly provided by an audio preamplifier.

The floating voltage source 410 may include a zener diode D1 and a constant current source 420, as previously described in conjunction with FIG. 3. In the example of FIG. 4, the constant current source 420 is a conventional circuit using a bipolar transistor Q3. Other constant current circuits may be used for the constant current source 420. Resistors R6 and R8 and diode D2 function as a voltage divider to establish a fixed voltage at a base of transistor Q3. The current through the collector of transistor Q3 is then determined by the value of the base voltage and the resistor R7, as follows:

$$I_1 = \frac{(V_P - V_{BE})R8}{R7(R6 + R8)} \tag{3}$$

wherein: $V_{BE}$=the forward voltage drop of the base-emitter junction of Q3, which is presumed equal to the forward voltage drop of the diode D2.

The voltage follower 415 may be, as shown in FIG. 4, bipolar transistor operating as an emitter follower. The voltage follower 415 may be a field effect transistor operating as a source follower. Since the fixed current $I_1$ set by the constant current source 420 flows through the emitter (or source if Q2 is a field effect transistor) of transistor Q2, the base-emitter voltage of transistor Q2 may be constant independent of the audio signal level at the base of Q2. Thus transistor Q2 may function as a voltage follower with a gain of essentially one.

In the example of FIG. 4, a third terminal T3 of the electret microphone capsule 405 may be connected to a bias voltage $V_{bias}$. The bias voltage may be set to be any value from ground to the DC power supply voltage $V_P$ by a variable resistor R9 serving as a variable voltage divider. The selection of the bias voltage may affect the operation of the electret microphone EM. For example, the selection of the bias voltage may affect the sensitivity of the electret microphone EM.

Figure 1A:
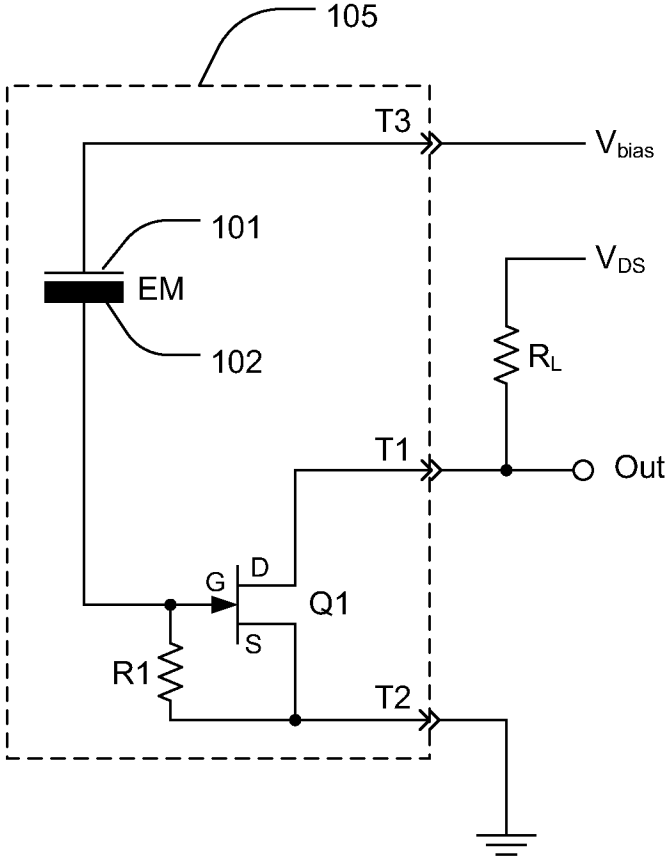
FIG. 1A Prior Art
FIG. 1A is a schematic diagram of a conventional electret microphone circuit.

The following Table I compares the performance of a simulated electret microphone capsule when the internal FET transistor is operated as an inverting amplifier as shown in FIG. 1A, as a source follower as shown in FIG. 1B, and within the microphone circuit of FIG. 4. The performance data summarized in Table I was measured on actual circuits using an audio voltage source in series with a capacitor to simulate the audio signal provided by an electret microphone. The microphone circuit of FIG. 4 exhibits substantially increased dynamic range and greatly reduced total harmonic distortion compared to the conventional circuits of FIG. 1A and FIG. 1B. Note that dBu is a measure of audio signal voltage, where 0 dBu is the voltage necessary to provide 1 milliwatt of power into a load of 600 ohms (about 0.775 volts RMS). 10 dBu represents an audio signal amplitude of 2.45 volts RMS, and 20 dBu represents an audio signal amplitude of 7.75 volts RMS.

TABLE I

| Configuration | Inverting amplifier | Source follower | Improved circuit |
|---|---|---|---|
| FIG. | FIG. 1A | FIG. 1B | FIG. 4 |
| Gain | +28 dB | −1.2 dB | −0.1 dB |
| Max Sound Pressure Level (5% clipping) | 116 dB | 139 dB | 152 dB |
| Total Harmonic Distortion (+10 dBu output) | 2.4% | 0.25% | 0.003% |
| Total Harmonic Distortion (+20 dBu output) | clipping | clipping | 0.025% |
| Input capacitance | 55 pf | 1.8 pf | <0.25 pf |

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A microphone, comprising:

an electret microphone capsule including first, second, and third terminals a field effect transistor having a drain connected to the first terminal and a source connected to the second terminal an electret microphone connected between the third terminal and a gate of a field effect transistor a floating DC voltage source having a first end connected to the first terminal of the electret microphone capsule and a second end a load resistor connected between the second end of the floating DC voltage source and the second terminal of the electret microphone capsule a voltage follower having an output connected to the first terminal of the electret microphone capsule and the first end of the floating DC voltage source a coupling capacitor connected to couple an audio signal from the second terminal of the electret microphone capsule to an input of the voltage follower.

2. The microphone of claim 1, further comprising a reference voltage source coupled to the input of the voltage follower through a second resistor.

3. The microphone of claim 1, wherein the voltage follower is selected from an operational amplifier with absolute negative feedback, a bipolar transistor emitter follower, and a field effect transistor source follower.

4. The microphone of claim 1, wherein the floating voltage source is a battery.

5. The microphone of claim 1, wherein the floating voltage source comprises a zener diode.

6. The microphone of claim 5, further comprising a circuit to cause a constant current to flow through the zener diode.

7. The microphone of claim 6, wherein the voltage follower is one of a bipolar transistor emitter follower and a field effect transistor source follower, and the constant current flows through the emitter of the bipolar transistor or the source of the field effect transistor, respectively.

8. The microphone of claim 1, further comprising a bias voltage source connected to the third terminal of the electret microphone capsule.

9. The microphone of claim 8, wherein the bias voltage is variable.

10. The microphone of claim 8, wherein the bias voltage may be selected from two or more voltage values using a switch.

11. A circuit, comprising:

first, second, and third terminals configured for connection to drain, source, and bias terminals, respectively, of an electret microphone capsule a floating DC voltage source having a first end connected to the first terminal and a second end a load resistor connected between the second end of the floating DC voltage source and the second terminal a voltage follower having an output connected to the first terminal and the first end of the floating DC voltage source a coupling capacitor connected to couple an audio signal from the second terminal to an input of the voltage follower.

12. The circuit of claim 11, further comprising a reference voltage source coupled to the input of the voltage follower through a second resistor.

13. The circuit of claim 11, wherein the voltage follower is selected from an operational amplifier with absolute negative feedback, a bipolar transistor emitter follower, and a field effect transistor source follower.

14. The circuit of claim 11, wherein the floating voltage source is a battery.

15. The circuit of claim 11, wherein the floating voltage source comprises a zener diode.

16. The circuit of claim 15, further comprising a circuit to cause a constant current to flow through the zener diode.

17. The circuit of claim 16, wherein the voltage follower is one of a bipolar transistor emitter follower and a field effect source follower and the constant current flows through the emitter of the bipolar transistor or the source of the field effect transistor, respectively.

18. The circuit of claim 11, further comprising a bias voltage source connected to the third terminal.

19. The circuit of claim 18, wherein the bias voltage is variable.

20. The circuit of claim 18, wherein the bias voltage may be selected from two or more voltage values using a switch.

21. A method of operating an electret microphone capsule, comprising:

applying an essentially constant DC voltage between a drain terminal and a source terminal of the electret microphone capsule through a load resistor in series with the source terminal coupling an audio signal from the source terminal of the electret microphone capsule through a capacitor to an input of a voltage follower applying an output voltage from the voltage follower to the drain terminal of the electret microphone capsule.

22. The method of claim 21, further comprising applying a bias voltage to a bias terminal of the electret microphone capsule.

* * * * *